US009446293B2

(12) United States Patent
Lee

(10) Patent No.: US 9,446,293 B2
(45) Date of Patent: Sep. 20, 2016

(54) GOLF CLUB

(71) Applicant: Sang Mun Lee, Chungcheongbuk-do (KR)

(72) Inventor: Sang Mun Lee, Chungcheongbuk-do (KR)

( * ) Notice: Subject to any disclaimer, the term of this patent is extended or adjusted under 35 U.S.C. 154(b) by 0 days.

(21) Appl. No.: 14/633,370

(22) Filed: Feb. 27, 2015

(65) Prior Publication Data

US 2015/0297959 A1 Oct. 22, 2015

(30) Foreign Application Priority Data

Apr. 18, 2014 (KR) ..... 20-2014-0003126 U

(51) Int. Cl.
*A63B 53/04* (2015.01)
*A63B 69/36* (2006.01)
*A63B 59/00* (2015.01)

(52) U.S. Cl.
CPC ..... *A63B 53/0466* (2013.01); *A63B 60/50* (2015.10); *A63B 2053/0458* (2013.01); *A63B 2053/0495* (2013.01)

(58) Field of Classification Search
CPC ..... A63B 53/0466; A63B 60/50; A63B 2053/0458; A63B 2053/0495; A63B 59/0092
USPC ..... 473/324–350, 287–292, 457, 519
See application file for complete search history.

(56) References Cited

U.S. PATENT DOCUMENTS

| | | | | |
|---|---|---|---|---|
| 1,825,244 | A * | 9/1931 | Nero | A63B 53/08 473/333 |
| 3,589,731 | A | 6/1971 | Chancellor, Jr. | |
| 4,600,190 | A * | 7/1986 | Berokoff | A63B 15/005 473/457 |
| 4,671,508 | A * | 6/1987 | Tetreault | A63B 69/0002 473/201 |
| 2007/0087860 | A1* | 4/2007 | Chen | A63B 53/0466 473/333 |

FOREIGN PATENT DOCUMENTS

| | | |
|---|---|---|
| JP | 2000014835 | 1/2000 |
| KR | 20040075148 | 8/2004 |
| KR | 20080008762 | 1/2008 |

* cited by examiner

*Primary Examiner* — Sebastiano Passaniti
(74) *Attorney, Agent, or Firm* — IPLA P.A.; James E. Bame

(57) ABSTRACT

A golf club having a face adapted to directly strike a golf ball thereon, a pipe-shaped shaft coupled to the club head, and a grip coupled to the top end periphery of the shaft, includes a first protrusion formed on one side of an internal surface of a face thereof; a second protrusion formed on the rear surface of the interior thereof in such a manner as to face the first protrusion and having a lubricating oil inlet passage formed thereon in such a manner as to be connected to the outside; a spring disposed engagedly between the first protrusion and the second protrusion; a bolt detachably mounted on the entrance of the lubricating oil inlet passage of the second protrusion; and an elastic structure slidingly operating along the spring in such a manner as to surround the spring.

5 Claims, 3 Drawing Sheets

GOLF CLUB

CROSS REFERENCE

This application claims foreign priority under Paris Convention to Korean Patent Application No. 20-2014-0003126, filed 18 Apr. 2014, with the Korean Intellectual Property Office.

BACKGROUND

The present invention relates to a golf club, and more particularly, to a golf club that has a structure of a club head capable of improving the distance of a golf ball.

Unlike other sports, generally, golf is the sport depending sensitivitely upon a player's drive shot and swing postures, a club's length, and his or her grasping state on a grip of the club.

There are three types of golf clubs used for striking a golf ball. Drivers are mainly used for the long distance fairway of the golf ball, irons for the positioning of the golf ball from a fair way to the green, and putters for rolling the golf ball into the cup.

Since the furthest distance of the golf ball is achieved with the drivers or irons among the golf clubs, it is very important to improve the distance of the golf ball through the drivers or irons. So as to maximize the distance of the golf ball, for example, conventional drivers or irons have heavy heads or long club lengths.

However, the conventional drivers or irons have the restrictions in the improvement of the distance of the golf ball due to a golfer's physical limits in using the heavy heads or long club lengths.

SUMMARY OF THE INVENTION

Accordingly, the present invention has been made in view of the above-mentioned problems occurring in the prior art, and it is an object of the present invention to provide a golf club that has a structure of a club head capable of optimizing a repulsive force generated from a face of the club head to improve the distance of a golf ball.

To accomplish the above object, according to the present invention, there is provided a golf club including: a club head having a face adapted to directly strike a golf ball thereon; a pipe-shaped shaft coupled to the club head; and a grip coupled to the top end periphery of the shaft, wherein the club head includes: a first protrusion formed on one side of an internal surface of a face thereof; a second protrusion formed on the rear surface of the interior thereof in such a manner as to face the first protrusion and having a lubricating oil inlet passage formed thereon in such a manner as to be connected to the outside; a spring disposed engagedly between the first protrusion and the second protrusion; a bolt detachably mounted on the entrance of the lubricating oil inlet passage of the second protrusion; and an elastic structure slidingly operating along the spring in such a manner as to surround the spring.

According to the present invention, desirably, the elastic structure includes: a piston made of a high elastic metal and slidingly operating along the spring in such a manner as to surround the spring; a first elastic member disposed on one surface of the piston in such a manner as to surround the spring; and a second elastic member disposed on the other surface of the piston in such a manner as to surround the spring.

According to the present invention, desirably, the high elastic metal includes any one of titanium, phosphor bronze made by adding phosphorus to bronze, and tungsten, and the first elastic member and the second elastic member are formed of a ring-shaped plate made of an elastic material.

According to the present invention, desirably, the piston has a shape of a circular truncated cone increased gradually in diameter as the piston goes toward one surface thereof from the other surface thereof.

According to the present invention, desirably, the piston has a shape of a cylindrical or polygonal post.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENTS

Figure 1:
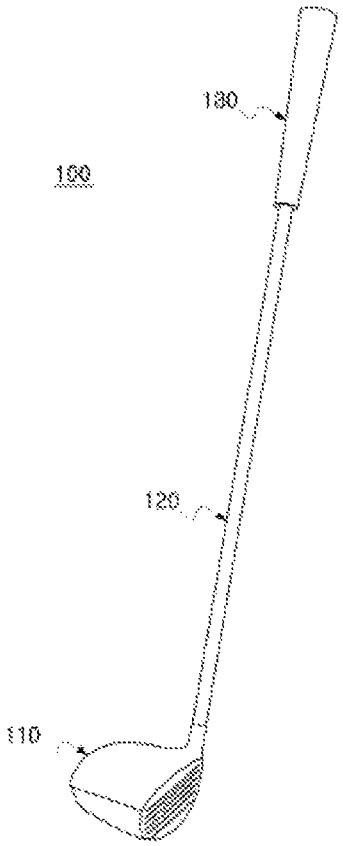
FIG. 1 is a perspective view showing a golf club according to the present invention.

Objects, characteristics and advantages of the present invention will be more clearly understood from the detailed description as will be described below and the attached drawings. In the description, it should be noted that the parts corresponding to those of the drawings are indicated by corresponding reference numerals. Further, the terms as will be discussed later are defined in accordance with the functions of the present invention, but may be varied under the intention or regulation of a user or operator. Therefore, they should be defined on the basis of the whole scope of the present invention. Therefore, they should be defined on the basis of the whole scope of the present invention. Furthermore, a detailed explanation on the well known components of the present invention will be avoided for the brevity of the description.

Hereinafter, an explanation on a golf club according to the present invention will be in detail given with reference to the attached drawing. FIG. 1 is a perspective view showing a golf club according to the present invention, FIG. 2 is a sectional view showing the internal structure of a club head of the golf club according to the present invention, and FIG. 3 is an exploded sectional view showing the internal structure of the club head of the golf club according to the present invention.

A golf club 100 according to the present invention serves to improve the distance of a golf ball, which is first applied to a driver, but may be of course applied to woods and irons.

The golf club 100 according to the present invention includes a club head 110 having an elastic structure 114 disposed at the inside thereof to improve a repulsive force against a golf ball when the club head 110 strikes the golf ball, a pipe-shaped shaft 120 coupled to the club head 110, and a grip 130 coupled to the top end periphery of the shaft 120.

Figure 2:
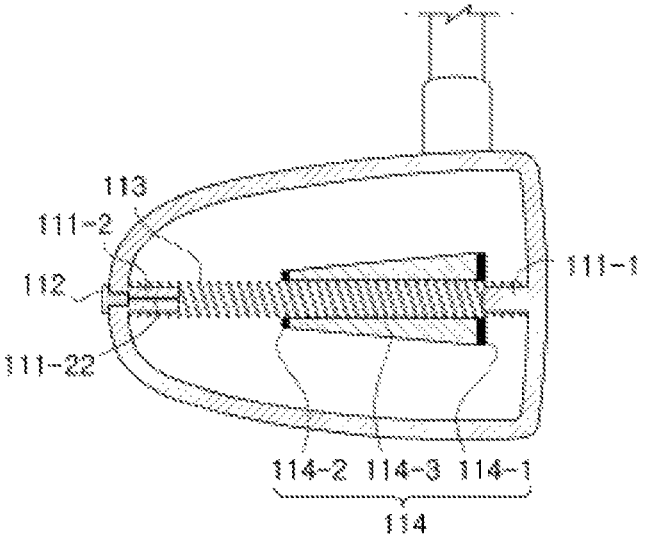
FIG. 2 is a sectional view showing the internal structure of a club head of the golf club according to the present invention.
Figure 3:
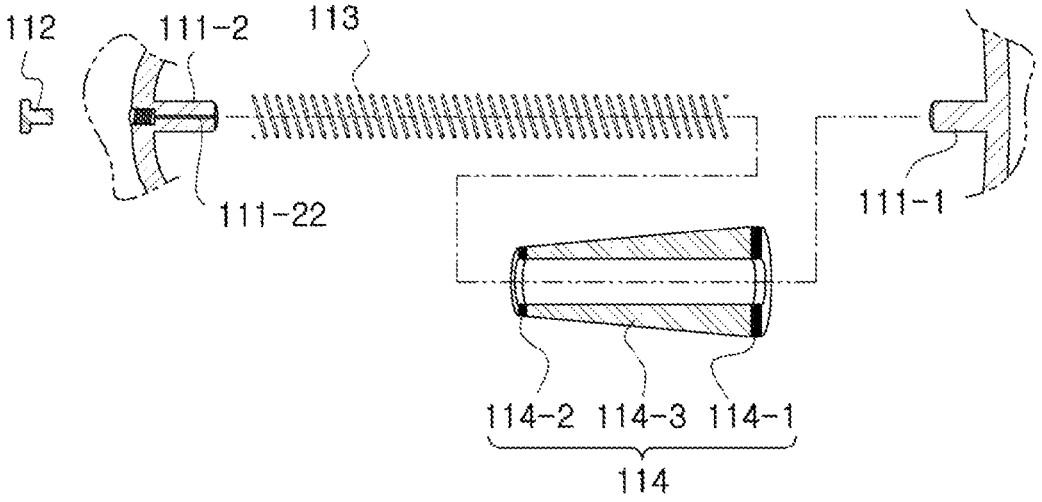
FIG. 3 is an exploded sectional view showing the internal structure of the club head of the golf club according to the present invention.

As shown in FIG. 2, the club head 110 is a head housing portion constituting the outer shape thereof and includes a face adapted to directly strike a golf ball thereon, a first protrusion 111-1 formed at the center of the internal surface of the face, a second protrusion 111-2 formed at the rear surface of the interior thereof in such a manner as to face the first protrusion 111-1 and having a lubricating oil inlet passage 111-22 penetrated thereinto, a bolt 112 detachably mounted on the entrance of the lubricating oil inlet passage 111-22, a spring 113 located engagedly between the first protrusion 111-1 and the second protrusion 111-2, and an elastic structure 114 slidingly operating in such a manner as to surround the spring 113.

In more detail, the first protrusion 111-1 protrudes inward from one side of the internal surface of the face to correspond to a sweet spot of the face of the club head 110, and at this time, the first protrusion 111-1 is fitted surroundedly to one side of the spring 113.

Further, the second protrusion 111-2 protrudes inward from one side of the rear surface of the interior of the club head 110 in such a manner as to face the first protrusion 111-1 and has the lubricating oil inlet passage 111-22 connected to the outside. At this time, the second protrusion 111-2 is coupled to the spring 113 in such a manner as to be surrounded with the other side of the spring 113.

Further, the lubricating oil inlet passage 111-22 is open or closed by means of the bolt 112 detachably screw-coupled to the entrance thereof, and lubricating oil is introduced into the lubricating oil inlet passage 111-22 to allow the elastic structure 114 to slidingly operate gently along the spring 113.

The elastic structure 114 includes a piston 114-3 made of a high elastic metal and slidingly operating along the spring 113 in such a manner as to surround the spring 113, a first elastic member 114-1 disposed on one surface of the piston 114-3 in the direction of the first protrusion 111-1, and a second elastic member 114-2 disposed on the other surface of the piston 114-3 in the direction of the second protrusion 111-2.

In this case, for example, the high elastic metal used to form the piston 114-3 includes titanium having a modulus of 107 GPa, phosphor bronze made by adding phosphorus to bronze, and tungsten W. Of course, the high elastic metal is not limited to the above-mentioned metals, but may be formed of all metals or alloys having high elasticity.

The first elastic member 114-1 and the second elastic member 114-2 are formed of a ring-shaped plate made of an elastic material like rubber, silicone, synthetic resin and so on, thus absorbing the impacts generated in the interior of the club head 110 upon the strike of the golf ball to prevent the piston 114-3 from being broken and to transmit the repulsive force against the golf ball to the face.

As shown in FIG. 3, the piston 114-3 has a shape of a circular truncated cone increased gradually in diameter as it goes toward one surface thereof in the direction of the first protrusion 111-1 from the other surface thereof in the direction of the second protrusion 111-2. In this case, the reason why the piston 114-3 has the circular truncated cone is that the whole weight of the piston 114-3 is reduced and the repulsive force against the golf ball is effectively transmitted to the face.

In addition thereto, of course, the piston 114-3 may have shapes of cylindrical, rectangular, and polygonal posts.

At this time, one surface of the piston 114-3 on which the first elastic member 114-1 is disposed has the same diameter as or smaller diameter than the sweet spot of the face.

Under the above-mentioned configuration of the golf club 100, according to the present invention, at the moment of the impact between the golf ball and the face, the face pressed against the golf ball hits back by means of the elastic structure 114 disposed inside the club head 110, thus optimizing the repulsive force pushing the golf ball through the face to improve the distance of the golf ball.

Figure 4A:
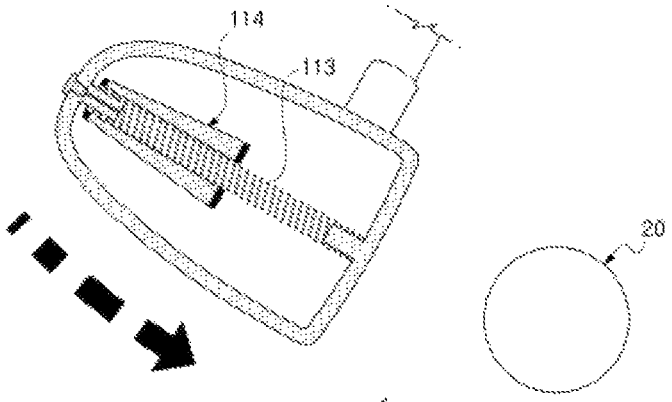
FIGS. 4*a* to 4*c* are sectional views showing the striking principle of the golf club according to the present invention.
Figure 4B:
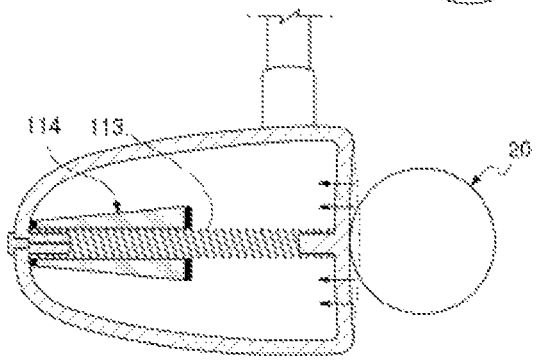
Figure 4C:
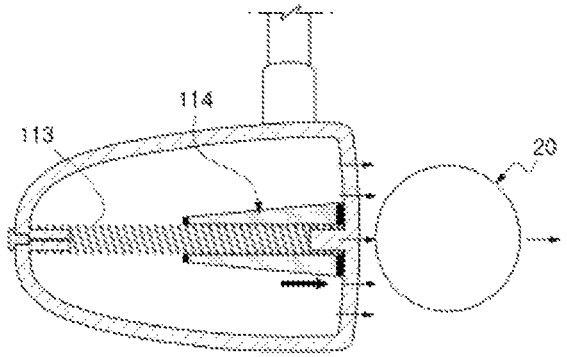

Hereinafter, an explanation on the striking operation using the golf club 100 according to the present invention will be given with reference to FIGS. 4*a* to 4*c*. FIGS. 4*a* to 4*c* are sectional views showing the striking principle of the golf club according to the present invention.

As shown in FIG. 4 *a*, if the golf club 100 strikes the golf ball 20 in the state of being swung back, the face of the golf club 100 pushes inward by means of the golf ball 20, and the striking load is transmitted to the elastic structure 114 through the face, as shown in FIG. 4*b*.

At this time, the elastic structure 114 is located around the second protrusion 111-2 along the spring 113 in the state where the golf club 100 is swung back, and when the golf club 100 strikes the golf ball 20, the elastic structure 114 momentarily slides along the spring 113 in the direction of the first protrusion 111-1.

As the repulsive action against the impact applied to the face, as shown in FIG. 4*c*, a reaction for rebounding the golf ball 20 is generated from the face of the club head 110, and at the same time, the elastic structure 114 inserts the first protrusion 111-1 thereinto to hit back the rear surface of the face.

At this time, since the lubricating oil introduced into the lubricating oil inlet passage 111-22 is applied to the spring 113 and the elastic structure 114, the elastic structure 114 slidingly operates along the spring 113, without having any friction against the spring 113, and easily hits back the rear surface of the face.

According to the present invention, therefore, as the repulsive action against the striking of the golf ball 20, the repulsive force generated from the face of the club head 110 and the repulsive force generated when the rear surface of the face is hit back by means of the elastic structure 114 are applied to the golf ball 20, thus generating high repulsive force against the golf ball 20.

As mentioned above, the golf club 100 according to the present invention can apply the repulsive force generated from the elastic structure 114 disposed inside the club head 110 as well as the repulsive force generated from the face of the club head 110 to the golf ball 20, thus improving the distance of the golf ball 20.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A golf club comprising:

a club head having a face adapted to directly strike a golf ball thereon;

a pipe-shaped shaft coupled to the club head; and a grip coupled to a top end periphery of the shaft, wherein the club head comprises:

a first protrusion formed on one side of an internal surface of a face thereof;

a second protrusion formed on a rear surface of an interior thereof to face the first protrusion and having a lubricating oil inlet passage formed thereon;

a spring disposed engagedly between the first protrusion and the second protrusion;

a bolt detachably mounted on an entrance of the lubricating oil inlet passage of the second protrusion; and an elastic structure slidingly operating along the spring to surround the spring.

2. The golf club according to claim 1, wherein the elastic structure comprises:

a piston made of a high elastic metal and slidingly operating along the spring to surround the spring;

a first elastic member disposed on one end surface of the piston to surround the spring; and a second elastic member disposed on an other surface of the piston to surround the spring.

3. The golf club according to claim 2, wherein the high elastic metal comprises any one of titanium, phosphor bronze made by adding phosphorus to bronze, and tungsten, and the first elastic member and the second elastic member are formed of a ring-shaped plate made of an elastic material.

4. The golf club according to claim 2, wherein the piston has a shape of a circular truncated cone.

5. The golf club according to claim 2, wherein the piston has a shape of a cylindrical or polygonal post.

* * * * *